United States Patent [19]

Mead et al.

[11] 4,145,273

[45] Mar. 20, 1979

[54] TRANSFORMER OIL PROCESSING

[75] Inventors: Theodore C. Mead, Port Neches; Avilino Sequeira, Jr., Port Arthur; Norman R. Odell, Nederland, all of Tex.

[73] Assignee: Texaco Inc., New York, N.Y.

[21] Appl. No.: 811,335

[22] Filed: Jun. 29, 1977

[51] Int. Cl.[2] ..... C10G 27/00; C10G 34/00

[52] U.S. Cl. ..... 208/3; 208/14

[58] Field of Search ..... 208/3, 14, 111

[56] References Cited

U.S. PATENT DOCUMENTS

| | | | |
|---|---|---|---|
| 1,988,731 | 1/1935 | Haslam | 208/3 |
| 2,365,220 | 12/1944 | Schultz et al. | 208/3 |
| 2,370,228 | 2/1945 | Bruun et al. | 208/144 |
| 2,905,704 | 9/1959 | Hirschler | 208/3 |
| 3,849,288 | 11/1974 | Milstein et al. | 208/14 |

*Primary Examiner*—Herbert Levine

*Attorney, Agent, or Firm*—Carl G. Ries; Thomas H. Whaley; Kenneth R. Priem

[57] ABSTRACT

A transformer oil processing sequence is disclosed. The process comprises contacting a naphthenic based oil with an oxygen-containing gas in the presence of a permanganate under mild oxidation conditions of temperature and pressure and caustic washing the resultant product. The caustic washed product is then subjected to two pass hydrogenation to provide a transformer oil having superior Doble oxidation resistance values.

9 Claims, No Drawings

TRANSFORMER OIL PROCESSING

BACKGROUND OF THE INVENTION

Field of the Invention

This invention pertains to the field of processing transformer oils.

This invention relates to mineral oils used as electrical insultating oils as in transformer switches and the like and generally called transformer oils. More particularly, it relates to the use of a particular processing sequence beginning with the preoxidation of the mineral oil under very mild conditions of temperature and pressure before further processing steps.

Oils used as electrical insulating oils in transformers or switches must be capable of resisting current conduction at voltage levels much higher than the voltages at which a transformer switch is normally operated since severe surges of voltage can occur in transformers and switches exposed to disturbances such as lightning. This property of an insulating oil is termed its impulse strength. In addition, these oils must have an inherent resistance to oxidative processes which break down such oils and make then unfit for their intended purpose. With additive oxidation inhibitors they should show a substantial increase in oxidative resistance over their inherent oxidative resistance.

Heretofore insulating oils with acceptable properties have been produced by various methods which usually included sulfuric acid treating. However, sulfuric acid treating is not preferred since it produces large amounts of sludge which must be disposed of. Environmental considerations demand that processes be developed which eliminate this sludge problem. In the present invention, a catalyzed preoxidation step is used which when used in combination with the other steps produces an oil having superior properties necessary for insulating oils. U.S. Pat. No. 3,725,253 discloses a process for the purification of lubricating oils which comprises first reacting the mineral oil with an oxygen containing gas catalytically at temperatures ranging from 108° C. to 280° C. This severe process results in the destruction of a large percentage of the incoming charge stock resulting in a very large amount of sludge. Vacuum distillation is required to recover the desired compounds produced in the oxidation step from the sludge. Thus, the process of the patent is completely different from the process of the present invention since the preoxidation step in the present invention is carried out at a much lower temperature resulting in almost no impurity generation. As a consequence, vacuum distillation is not required at the end of the oxidation step in the present process. Thus, it is clear that the patent is directed to a completely different process which has as its aim a completely different objective and achieves different results than this invention.

U.S. Pat. No. 3,105,812 describes a process for removing nitrogen-containing compounds from cracking and hydrocracking feed stocks by catalytic oxidation followed by hydrogenation. The oxidation is catalyzed by phosphorous oxide or a phosphorous oxide and vanadium oxide mixture. As the patent points out, the vanadium oxide catalyst, which is a relatively well known oxidation catalyst, is not very effective used alone. Although the claims of the patent include a temperature between 100° and 600° F. for the oxidation step, the examples given in the patent were carried out at from 300° to 400° F. It has been found in using the process of our invention that oxidation of transformer oil stocks can be carried out at a much lower temperature routinely. This is surprising in view of the data in U.S. Pat. No. 3,105,812. At column 10, lines 51–59 the patent teaches that a charge stock boiling in the range of a typical transformer oil distillate (550°–750° F.) is best hydrogenated at 800–1600 psi. Using the process of our invention, the hydrogenation pressure is much lower.

The invention to be disclosed below uses a unique catalyst system for preoxidizing a transformer oil feed stock at very mild conditions. The fact that this can be done is surprising in view of the prior art which teaches oxidation of hydrocarbon oil feed stocks at much more severe conditions. The mild conditions to be delineated below have very real advantages in fuel savings, required metallurgy and capital investment as well as other considerations.

SUMMARY OF THE INVENTION

The invention comprises first treating a suitable naphthenic transformer oil charge stock by catalytic oxidation at a temperature below about 275° F. and at pressure ranging up to about 300 psi in the presence of a catalytic quantity of an alkali or alkaline earth metal permanganate; second contacting the oil with an aqueous solution of a base; thirdly contacting the oil with hydrogen in the presence of a hydrogenation catalyst at a temperature of from about 400 to 675° F. and at a pressure from about 15 to 400 psi at a space velocity ranging from 0.1 to 10.0 vol/vol/hr and lastly contacting the oil with hydrogen again as above.

DESCRIPTION OF THE PREFERRED EMBODIMENTS

Examples of suitable hydrocarbon oil charge stocks for the process of this invention are those naphthenic distillates which typically boil in the range of 250° to 400° C. and have viscosities in the range of 40 to 100 SUS, preferably 50 to 60 SUS at 100° F. It is also possible to obtain transformer oils from distillates with viscosities as low as 30 and as high as 150 SUS at 100° F. The transformer oil stock are initially obtained from the distillation of crude naphthenic petroleum. The stock may be obtained as overhead from a vacuum distillation or may be obtained from the residue of vacuum distillation by deasphalting the residue by contact, for example, with a deasphalting agent such as propane, butane and the like or mixtures thereof.

Oxidation

There are present in unprocessed lubricating oils molecular structural types which are particularly susceptible to oxidation and thermal and chemical degradation. These types include olefins, nitrogenous compounds, other compounds containing hetereoatoms, certain types of aromatics and others. If allowed to remain in transformer oils, oxidation products of these species are polar or acidic in nature and tend to degrade the electrical insulating properties of transformer oils. Sulfuric acid treating has in the past removed such oxidizable species. This invention will show that oxidizing conditions, not involving the use of sulfuric acid, can oxidize susceptible molecular types. The oxidates thus formed can then be removed or rendered innocuous by other processing steps to be pointed out herebelow.

The oxidation step is carried out catalytically with an alkali or alkaline earth metal permanganate being the preferred catalyst. Especially preferred is potassium permanganate. Operable concentration range of the catalyst is from 0.001 to 5.0 weight percent basis oil. Catalysts may be used in solid form in which case the optimum range is from 0.5 to 3.5 weight percent. The catalyst may be added as a dilute aqueous solution in which case the preferred concentration is from 0.001 to 1.0 weight percent.

The temperature at which the oxidation step should be performed is from ambient temperature to about 275° F. The preferred range is from about 150° to 275° F. This temperature may vary depending on the rate at which air is fed into the reactant mixture. However, the oxidation temperature is a function of the exothermic temperature of the reaction and generally does not require external heating. It is preferred to adjust the air dosage rates so that the heat generated by the oxidation is just sufficient to maintain the required mild reaction temperature.

The operable pressure for the oxidation reaction is up to about 300 psi. It is preferred to operate at about atmospheric pressure. The dosage rate of oxidizing gas (oxygen) is from about 0.01 to 5.0 SCF per minute per kilogram of oil. However, this dosage rate will depend on the concentration of inert diluent in the oxidizing gas, and the desired operating temperature as well as other operating variables. It is preferred to use from about 0.01 to 3.0 SCF per minute per kilogram of oil when possible.

The oxidizing gas may be chosen from the group consisting of air, oxygen, ozone, oxides of nitrogen and combinations of these with addition of inert diluents such as nitrogen. It is preferred to use air and oxygen-nitrogen mixtures whenever possible.

Caustic Washing

Caustic washing is the intimate contact of an aqueous solution of caustic (basic) material with the oil. Caustic washing may be accomplished with sodium hydroxide, sodium carbonate, soda ash, potash or similar bases as reageants. The procedures of caustic washing are well known and need not be discussed further.

Hydrogenation

Catalytic hydrogenation (hydrorefining) is performed at a temperature between at about 400° to 675° F. preferentially between about 500° to 600° F. under a hydrogen pressure between about 15 to 400 psi preferably between about 300 and 350 psi, utilizing a hourly space velocity (v/v/hr) of between about 0.1 to 10 volumes of oil per volume of catalysts per hour, preferably between about 0.5 to 1.5 vol/vol/hr with a hydrogen dosage of between about 50 and 500 standard cubic feet per barrel (scfb), preferably between about 200 and 400 scfb. The hydrogen gas used for the hydrogenation step need not necessarily be a pure hydrogen. Hydrogen having a purity of at least about 65 volume percent preferably about 75 volume percent may be employed.

The catalyst employed in the hydrogenation step generally comprises a hydrogenation component on a support. The principal ingredient cf the hydrogenation component is a Group VIII metal or mixtures of Group VIII metals or compounds thereof such as the oxides or sulfides. Examples of Group VIII metals which may be used in the hydrogenating compound are a nickel cobalt or iron or mixtures thereof. The Group VIII metal should be present in an amount between about 2 and 10 weight percent, preferably between about 5 and 6 weight percent calculated as the metal oxide based on the total weight of the catalyst composite. In conjunction with the Group VIII metal, a Group VI metal such as molybdenum or tungsten may be used. In such case, the Group VI metal may be present in an amount between about 10 and 30 weight percent calculated as metal oxide based on the weight of the composite, a preferred range being about 12 and 15 weight percent.

The hydrogenating catalyst component is carried on a base comprising a refractory inorganic oxide material such as alumina, silica, magnesia, zirconia, titania, crystalline alumino silicates and the like and mixtures thereof.

As the following data shows, a satisfactory transformer oil can only be prepared when two pass hydrogeneration under the above conditions is utilized.

EXPERIMENTAL

A transformer base oil stock was treated as shown in the table below. As is shown, the oil which was preoxidized and two pass hydrogenated displayed superior properties to all other sequences.

TABLE I

DOBLE OXIDATION TEST RESULTS OF OXIDIZED AND/OR HYDROGENATED TRANSFORMED OILS

| Sequence | Preoxidized[2] | 1-Pass Hydrogenate[3] | 2-Pass Hydrogenate[3] | Doble Values, hr[4] Sample 1 PFVOT | Sample 1 SFL | Sample 2 PFVOT | Sample 2 SFL |
|---|---|---|---|---|---|---|---|
| Base Oil[1] | No | No | No | 0 | 0 | 0 | 0 |
| | Yes | No | No | 0 | 0 | 0 | 0 |
| | No | Yes | No | 0 | 8 | 0 | 8 |
| | No | Yes | Yes | 24 | 16 | 24 | 16 |
| | Yes | Yes | No | 64 | 40 | 46 | 40 |
| Method of invention | Yes | Yes | Yes | 66 | 88 | 68 | 88 |
| Doble Specifications | | | | 64 | 64 | 64 | 64 |

[1]Base oil is a 55 SUS (100° F) naphthenic pale oil
[2]Conditions: 200° F and atomspheric pressure with potassium permanganate catalyst at 2.5 wt % concentration; air rate 4.0 SCFM (136 lb charge
[3]Conditions: 600° F, American Cyanamid Aero HDS-3 Nickel-Molybdenum on silica-alumina 350 psi $H_2$ (100%) 1.0 LHSV 400 SCFB $H_2$ dosage
[4]PFVOT — Power Factor Values Oxidation, (hrs)
SFL — Sludge Free Life, (hrs)

We claim:

1. A method of making transformer oils comprising
(a) contacting a naphthenic oil with an oxygen-containing gas in the presence of a catalyst comprising an alkali or alkaline earth metal salt of permanganate at a temperature below 275° F. and a pressure ranging up to about 300 psi, (b) washing the oxidized oil from (a) with an aqueous solution of a base, (c) contacting the washed oil from (b) with hydrogen in two stages in the presence of a hydrogenation catalyst at a temperature from about 400° to 675° F. at a pressure from about 15 to 400 psi at a space velocity ranging from 0.1 to 10.0 vol/vol/hr at a hydrogen dosage between about 50 and 500 scfb.

2. A method as in claim 1 wherein the oxygen-containing gas is air.

3. A method as in claim 1 wherein the catalyst in step (a) is potassium permanganate.

4. A method as in claim 1 wherein the temperature in step (a) is from about 150° to 275° F.

5. A method as in claim 1 wherein the temperature in step (c) is from about 550° to 600° F.

6. A method as in claim 1 wherein the pressure in step (c) is from about 300 to 400 psi.

7. A method as in claim 1 wherein the space velocity in step (c) is from about 0.5 to 1.5 vol/vol/hr.

8. A method as in claim 1 wherein the hydrogen dosage is from about 200 to 400 scfb.

9. A method of making transformer oils comprising (a) contacting a naphthenic oil with air in the presence of a catalyst comprising potassium permanganate at a temperature ranging from about 150° to 275° F. and at a pressure ranging from atmospheric to about 300 psi, (b) washing the oxidized oil from (a) with an aqueous solution of a base, (c) contacting the washed oil from (b) with hydrogen in two stages in the presence of a hydrogenation catalyst at a temperature from about 550° to 600° F. at a pressure from about 300 to 400 psi at a space velocity ranging from about 0.5 to 1.5 vol/vol/hr. at a hydrogen dosage between about 200 to 400 scfb.

* * * * *